US009283566B2

(12) United States Patent
Kheifets

(10) Patent No.: US 9,283,566 B2
(45) Date of Patent: Mar. 15, 2016

(54) CONFIGURATIONS FOR LINERS IN GRINDING MILL WITH GEARLESS MOTOR DRIVE

(75) Inventor: Alexander Kheifets, Coquitlam (CA)

(73) Assignee: Fluor Technologies Corporation, Sugar Land, TX (US)

( * ) Notice: Subject to any disclaimer, the term of this patent is extended or adjusted under 35 U.S.C. 154(b) by 248 days.

(21) Appl. No.: 13/390,049

(22) PCT Filed: Aug. 12, 2010

(86) PCT No.: PCT/US2010/045276

§ 371 (c)(1), (2), (4) Date: Apr. 27, 2012

(87) PCT Pub. No.: WO2011/019880

PCT Pub. Date: Feb. 17, 2011

(65) Prior Publication Data

US 2012/0217334 A1 Aug. 30, 2012

Related U.S. Application Data

(60) Provisional application No. 61/233,381, filed on Aug. 12, 2009.

(51) Int. Cl.

| | |
|---|---|
| ***B02C 17/22*** | (2006.01) |
| *B02C 13/282* | (2006.01) |
| *B02C 17/24* | (2006.01) |
| *B02C 17/00* | (2006.01) |

(52) U.S. Cl.

CPC ..... *B02C 17/22* (2013.01); *B02C 17/00* (2013.01); *B02C 17/24* (2013.01); *B02C 2013/2825* (2013.01); *Y10T 29/49* (2015.01)

(58) Field of Classification Search

CPC B02C 17/22; B02C 2013/2825; B02C 17/00; B02C 17/24; B23P 17/00

USPC ..... 241/182, 183

See application file for complete search history.

(56) References Cited

U.S. PATENT DOCUMENTS

| | | | | |
|---|---|---|---|---|
| 702,757 | A * | 6/1902 | Abbe | 241/70 |
| 1,224,933 | A * | 5/1917 | Jordan | 241/176 |
| 1,591,703 | A * | 7/1926 | Greenfield | 241/178 |

(Continued)

FOREIGN PATENT DOCUMENTS

| | | |
|---|---|---|
| CA | 2305481 | 10/2001 |
| DE | 102008008821 | 5/2009 |

(Continued)

OTHER PUBLICATIONS

T. Orser, V. Svalbonas and M. Van de Vijfeijken, CONGA: The World's First 42 Foot Diameter 28 MW Gearless Sag Mill, Sep. 2011, ABB, p. 14.*

*Primary Examiner* — Alexander P Taousakis
*Assistant Examiner* — Leonel Vasquez
(74) *Attorney, Agent, or Firm* — Conley Rose, P.C.; Kristin Jordan Harkins

(57) ABSTRACT

A grinding mill liner has a plurality of liner elements with respective bolt passages that are placed such that the passages, when the liner is installed into a mill shell, are placed outside a footprint of a peripheral device on the mill shell. Most typically, the peripheral device is a gearless motor drive that is operationally coupled to the mill shell in a position other than the end of the mill shell.

9 Claims, 3 Drawing Sheets

(56) References Cited

U.S. PATENT DOCUMENTS

| | | | | |
|---|---|---|---|---|
| 1,591,938 | A * | 7/1926 | Harrison | 241/183 |
| 2,216,784 | A * | 10/1940 | Payne | 29/525.14 |
| 2,274,331 | A * | 2/1942 | Howes | 241/183 |
| 2,980,352 | A | 4/1961 | Johnson | |
| 3,042,323 | A * | 7/1962 | Hall | 241/183 |
| 3,272,444 | A * | 9/1966 | Rich et al. | 241/176 |
| 3,903,439 | A * | 9/1975 | Kartman | 310/66 |
| 4,018,393 | A | 4/1977 | Larsen | |
| 4,270,705 | A | 6/1981 | Larsen | |
| 5,375,313 | A * | 12/1994 | Apodaca et al. | 29/252 |
| 6,189,280 | B1 | 2/2001 | Malmberg | |
| 6,343,756 | B1 | 2/2002 | Weil | |
| 6,655,617 | B2 * | 12/2003 | Hagedorn et al. | 241/170 |
| 6,719,227 | B2 * | 4/2004 | Scuccato | 241/36 |
| 6,904,980 | B2 | 6/2005 | Rubie | |
| 7,816,832 | B2 * | 10/2010 | Bade et al. | 310/179 |
| 2002/0175232 | A1 * | 11/2002 | Scuccato et al. | 241/30 |
| 2003/0052205 | A1 | 3/2003 | Tirschler | |
| 2003/0056352 | A1 * | 3/2003 | McLellan et al. | 29/252 |
| 2005/0279870 | A1 * | 12/2005 | Scuccato | 241/101.2 |
| 2006/0113416 | A1 * | 6/2006 | Tirschler | 241/299 |
| 2007/0180678 | A1 | 8/2007 | Salamanca | |
| 2008/0035771 | A1 * | 2/2008 | Thome | 241/101.2 |
| 2009/0126177 | A1 | 5/2009 | Coray | |
| 2010/0033035 | A1 * | 2/2010 | Hosle | 310/49.46 |
| 2010/0098514 | A1 | 4/2010 | Silva et al. | |
| 2010/0170976 | A1 * | 7/2010 | Thome | 241/285.1 |
| 2013/0008985 | A1 * | 1/2013 | Held et al. | 241/5 |
| 2013/0092777 | A1 * | 4/2013 | Belke et al. | 241/284 |

FOREIGN PATENT DOCUMENTS

| | | |
|---|---|---|
| EP | 1952887 | 8/2008 |
| WO | 2007/000019 | 1/2007 |

* cited by examiner

Prior Art Figure 1

Prior Art Figure 2

CONFIGURATIONS FOR LINERS IN GRINDING MILL WITH GEARLESS MOTOR DRIVE

This application claims priority to our copending U.S. provisional application with the Ser. No. 61/233,381, which was filed Aug. 12, 2009.

FIELD OF THE INVENTION

The field of the invention is liners for grinding mills, and especially as it relates to mounting arrangements of such liners.

BACKGROUND OF THE INVENTION

As the inside of grinding mill drums is subject to substantial impact during operation, all or almost all large-scale grinding mills include protective and replaceable liners that cover the inside of the drum. Usually, the liners are cast from metal and bolted to the mill drum by at least two bolts that traverse the liner, wherein the bolts are typically kept in place by a nut applied from the outside of the drum. For example, exemplary liner segments that are directly and indirectly attached to drum shell are described in U.S. Pat. No. 4,270,705. To reduce deformation, liner segments with small circumferential length can be employed as shown in EP 1 952 887 A1, which increases the number of bolts required. Interlocking protective tiles and matching fastener elements are depicted in U.S. Pat. Nos. 6,189,280 and 6,343,756.

There are numerous bolts suitable for coupling the liners to the drum shell, which may include ordinary bolts or those with one or more specialized structures. For example, U.S. Pat. No. 4,018,393 shows a bolt with enlarged surface contact area, and U.S. Pat. App. No. 2008/0197640 depicts improved bolts that can be removed at an angle.

To detach a worn liner, the nuts are removed using an impact wrench, the bolts are pushed inside the drum, and the liner plates are knocked out of the shell through so called knock-out holes. In most cases, nut and bolt removal is achieved using a hydraulically or pneumatically actuated bolt removal tool (BRT). Alternatively, where operation of the BRT is not practical or possible, the bolt can be removed using a sledgehammer. However, considering the size of many mills (e.g., ball mills up to 26 ft. and SAG mills up to and above 40 ft. diameter), bolts (e.g., 2 in. diameter (M48)) and liner weight 2-6 tons, the use of a sledgehammer as a removal tool is not only tedious and hazardous, but also time consuming. Due to the process critical nature of the milling in mining and other operations, downtime must be minimized to maintain profitability. There are numerous BRTs known in the art, and exemplary BRTS are described in U.S. Pat. No. 6,904,980, WO 2007/000019, and U.S. Pat. App. No. 2009/0126177. However, regardless of the manner of bolt removal using such tools, removal of bolts remains challenging, especially where an operator can not readily access the bolts with a BRT. For example, operational difficulties are compounded where the grinding mill drum has a gearless motor drive. In many cases, the gearless motor drive is located on a non-edge position of the mill shell and so covers a substantial part of the shell. Unfortunately, currently known and commercially available liner segments are configured such that the liner bolts are located under the cover of the gearless motor drive and are generally not accessible to the BRT. Consequently, most mill operators resort to use of a sledgehammer in a confined space. As is readily apparent, such operation is once again tedious and time consuming.

Alternatively, to reduce downtime caused by bolt removal, a robotic system can be used as described in US 2007/0180678. Here, the system operates with a robotic arm and tool that automates the above bolt removal process. While such system generally allows for more rapid bolt removal, additional time for installation, programming, and maintenance is required. Moreover, malfunction of such system tends to add substantial delays to the liner removal. To entirely avoid issues associated with bolt removal, boltless liners can be used as described in CA 2305481 where a plurality of plate segments are held together by wedging plates. Here, the impact forces of the balls in the mill together with the particular plate arrangement are thought to stabilize the liner arrangement and to allow use of harder materials than normally used, which extends the projected life time. However, while such liner configurations provide significant advantages with respect to life time and installation, several new disadvantages arise. For example, removal of the plates for replacement is often more complicated as the plates have locked with each other. Moreover, as the wedging process is continuous, the entire liner must typically be replaced even when only a small section of the liner is defective.

Therefore, there is still a need to provide improved mounting arrangements for liners in grinding mills, and especially for grinding mills with a gearless motor drive.

SUMMARY OF THE INVENTION

The present invention is directed to various devices and methods for grinding mill liner elements having a plurality of bolt passages, wherein the bolt passages are placed such that the bolt passages, when the liner elements are installed into a mill shell, allow simplified and rapid removal of the liner elements without interference of a peripheral device that may be present on the mill shell.

In one aspect of the inventive subject matter, a method of manufacture of a grinding mill liner includes a step in which a plurality of liner elements is formed, and in which each liner element has a plurality of bolt passages. It is especially preferred that the bolt passages are placed such that the bolt passages (when the liner elements are installed into a mill shell) are positioned outside the footprint of a peripheral device (e.g., gearless motor drive) on the mill shell. Most typically, contemplated liner elements will include at least two bolt passages.

While not limiting to the inventive subject matter, it is generally preferred that the liner elements can be grouped in groups of liner elements having different average lengths. Typically, the difference in average length is at least 10%, and more typically at least 20%. Moreover, it is contemplated that liner elements may be further grouped into a third group, having an average length that is different from the first and second average lengths. In further preferred aspects, the bolt passages in a liner element have substantially equal distance from a hypothetical midline of the liner element. Additionally, it is contemplated that the mill shell has a plurality of knock-out holes that are positioned outside the footprint of the peripheral device on the mill shell such as to allow complete removal of the liner elements using the knock-out holes.

Particularly contemplated grinding mill liner elements will therefore have a plurality of bolt passages, wherein the bolt passages are placed such that the bolt passages, when the liner element is installed into a mill shell, are positioned outside a footprint of a peripheral device (e.g., gearless motor drive) on the mill shell. Most typically, the liner element will have at least two bolt passages, preferably with substantially equal distance from a hypothetical midline of the liner element. It is further generally preferred that the mill shell comprises a plurality of knock-out holes that are positioned outside the footprint of the peripheral device on the mill shell such as to allow complete removal of the liner element using the knock-out holes.

Therefore, grinding mills having the above mentioned liner elements are especially contemplated. In such mills, the liner elements have a first average length, and additional liner elements will have an average second length, wherein first and second lengths differ at least 10%, and more typically at least 20%. Where appropriate, still further liner elements may be included having an average third length, wherein the first, the second, and the third length are different. It is still further preferred that the mill shell comprises a plurality of knock-out holes that are positioned outside the footprint of a peripheral device on the mill shell such as to allow for complete removal of the liner element using the knock-out holes.

Various objects, features, aspects and advantages of the present invention will become more apparent from the following detailed description of preferred embodiments of the invention.

BRIEF DESCRIPTION OF THE DRAWING

Prior Art

Prior Art

DETAILED DESCRIPTION

According to the present inventive subject matter, grinding mill liners and grinding mill liner elements are contemplated where the bolt passages in the liner elements are placed outside the footprint of a gearless motor drive and/or other external device that is coupled to the mill shell. In most preferred aspects, contemplated liners have a length that is sufficient to extend with either or both ends beyond the gearless motor drive and/or other external device, and/or have bolt passages that are positioned such that the passages are disposed outside the footprint of the gearless motor drive and/or other external device. As used herein, the term "gearless motor drive" is meant to also include the housing of the gearless motor drive. Thus, the term "outside of the footprint" with respect to a peripheral device and a bolt passage means that the bolt passage is accessible by a bolt removal tool without removing the housing or without lifting the stator portion of the gearless motor drive.

Figure 1:
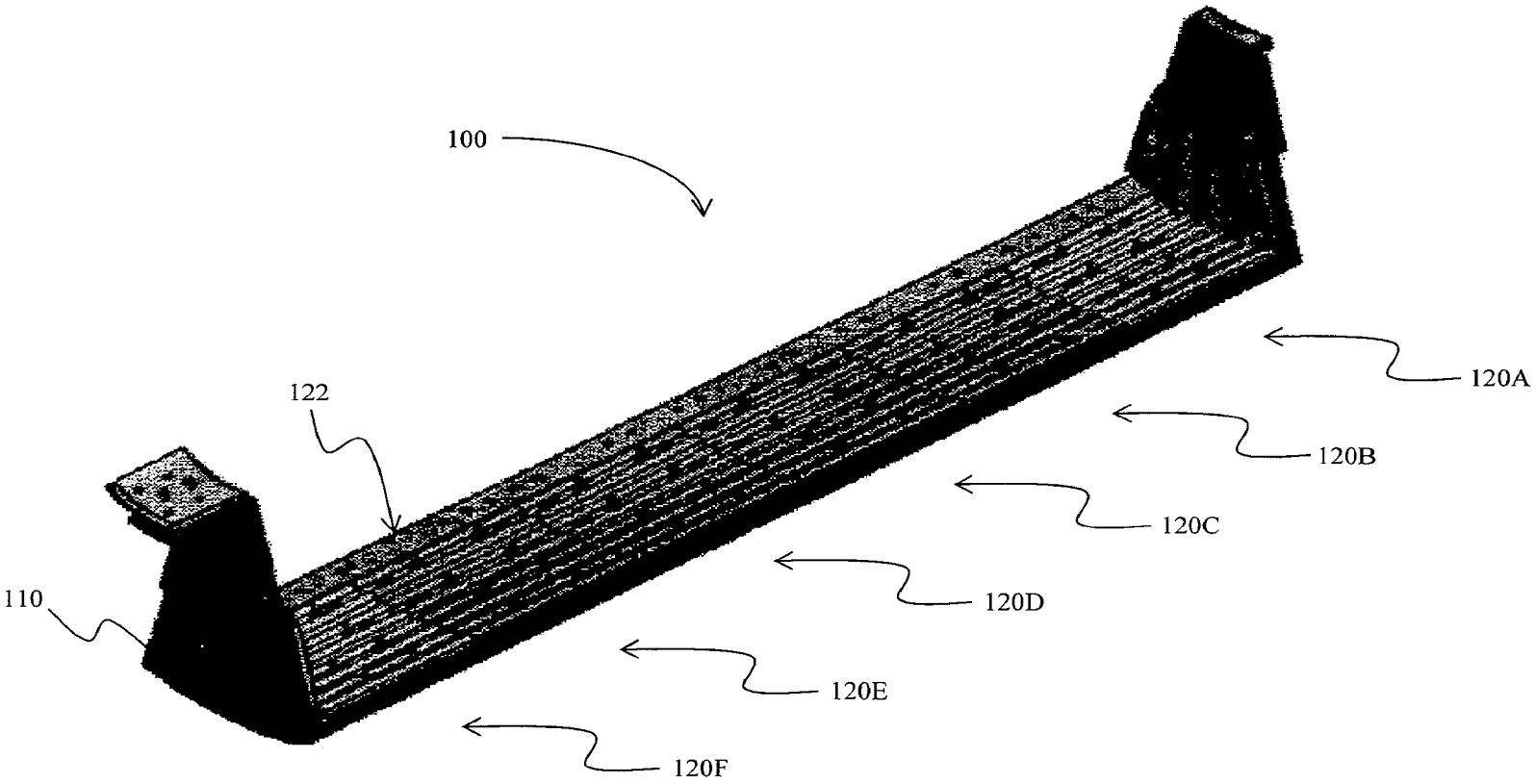
FIG. 1 is an schematic isometric view of a section of a mill shell section with a plurality of liner elements.
Figure 2:
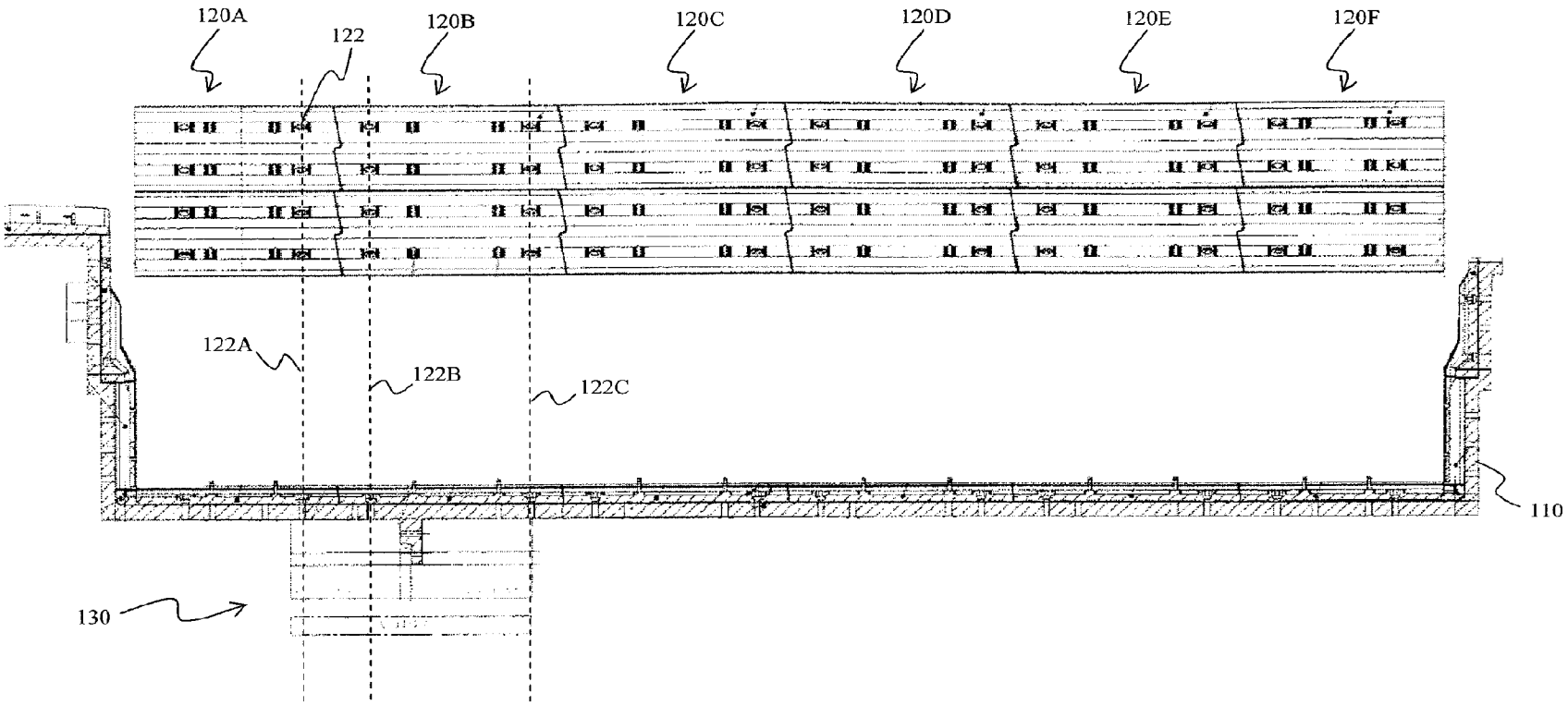
FIG. 2 is a schematic illustration of side and top view of the mill shell section and plurality of liner elements of Prior Art FIG. 1

Consequently, it should be appreciated that all manners of manual and/or automated bolt removal can be implemented in grinding mills having a gearless motor drive housing or other external device where such housing or other device would otherwise obstruct or limit access to the bolts. Prior Art FIG. 1 exemplarily illustrates a segment 100 of a grinding mill shell in which the shell portion 110 is lined on the inside with a plurality of groups of liner elements 120A-120F, and where each liner element has bolt passages 122 (only one bolt passage has a numeral here). Prior Art FIG. 2 exemplarily depicts top and side views of the liner elements. Here, the groups of liner elements 120A-120F have substantially the same length (average length difference equal or less than 5%) and are coupled to the mill shell 110 via bolts extending through bolt passages 122. As can be readily seen from lines 122A-122C in Prior Art FIG. 2, the bolt passages in group 120A and 120B coincide with the gearless motor drive 130. Thus, bolt removal in these groups is extremely difficult, and will in some circumstances even require removal of at least the housing of the gearless motor drive or a portion of the stator. Such manipulation typically requires significant additional labor and downtime of the mill, which is economically highly unattractive.

The inventor has now discovered that the above difficulties can be circumvented by modifying the length and/or positioning of the bolt passages such that the passages will no longer interfere with the external device (here: the gearless motor drive). In particularly preferred methods and devices, a grinding mill liner is contemplated that has a plurality of bolt passages, wherein the bolt passages are placed such that the passages, when the liner is installed into a mill shell, are positioned outside a footprint of a peripheral device of the mill shell. Typically, the peripheral device is a gearless motor drive cover, and the liner has at least two bolt passages.

Figure 3:
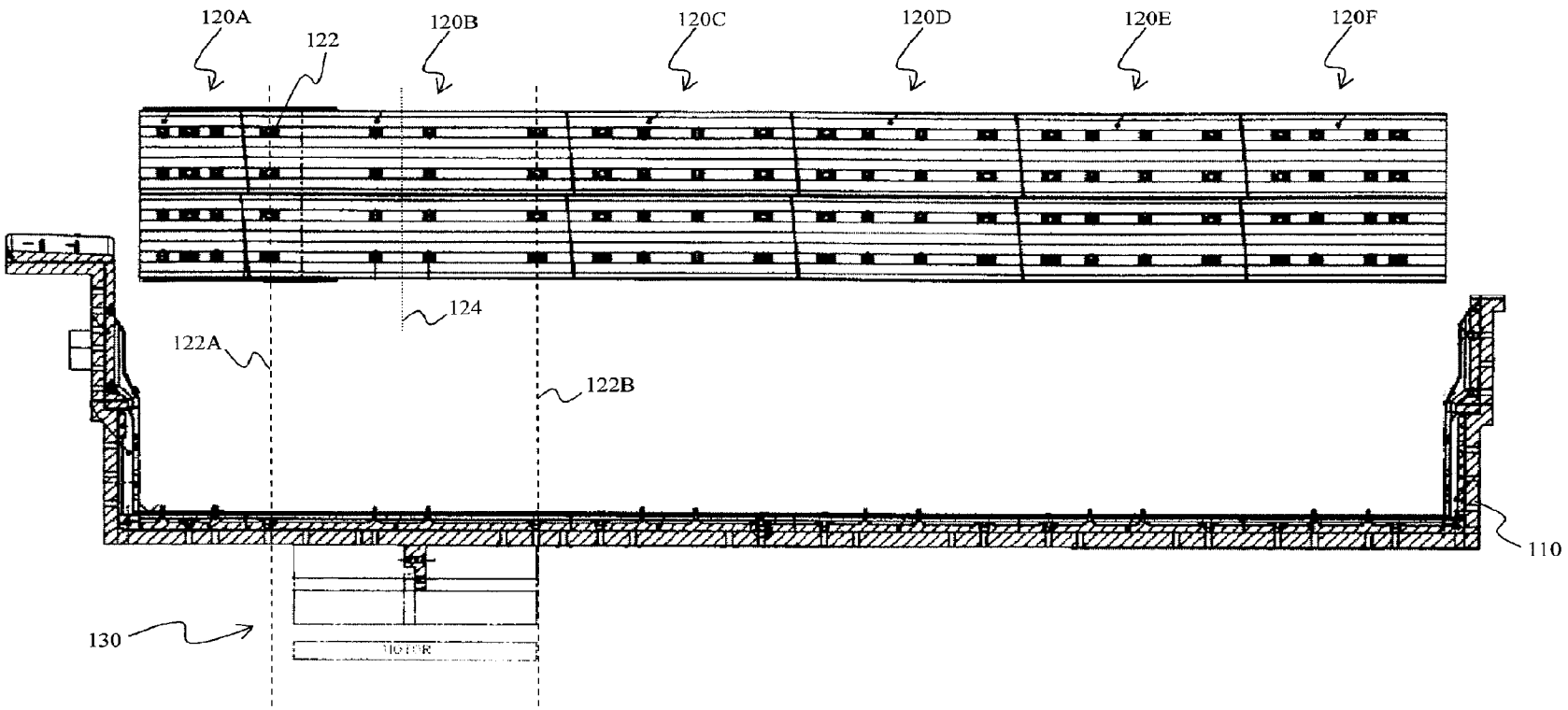
FIG. 3 is a schematic illustration of side and top view of the mill shell section and plurality of liner elements according to the inventive subject matter.

FIG. 3 exemplarily illustrates such devices and methods. Here, mill shell 110 with knock-out holes 112 (only one shown with numerals) has a plurality of groups of liner elements 120A-120F have a plurality of liner elements, wherein the first group 120A has liner elements with a relatively small average length, while the second group 120B has liner elements with a relatively large average length. Line 124 depicts the hypothetical midline of the liner elements. Remaining groups 120C-120F have liner elements with an average length that is intermediate to the first and second groups. As can be readily seen from lines 122A and 122B, the bolt passages are now positioned such that the passages substantially fall outside the footprint of the gearless motor drive and associated housing 130. It should be noted that such arrangement will necessitate the manufacture of liner elements with significantly different lengths, which may at least conceptually impede simple fabrication and installation. Moreover, while liner elements having different lengths will have different physicomechanical properties (e.g., resonance frequencies, excursion under load when installed, etc.), it is now contemplated that such differences will not negatively impact performance. On the contrary, as removal of the liners is now greatly facilitated, downtime will be reduced and economics are significantly improved.

Therefore, the inventors contemplate a method of producing a grinding mill liner in which a plurality of liner elements is formed with a plurality of bolt passages, respectively, wherein the bolt passages are placed such that the bolt passages, when the liner elements are installed into a mill shell, are positioned outside a footprint of a peripheral device on the mill shell. Most typically, the liner elements will have at least two bolt passages, which will correspond to respective openings in the grinding mill shell. As already noted above, it is generally preferred that a first group of the liner elements has a first average length, that a second group of liner elements has a second average length, and that first and second average lengths differ at least 10%, and more typically at least 20%. Most commonly, the remaining liner elements can be grouped into a third group of liner elements having an intermediate average length to facilitate production of the liner elements. In at least some cases, the average length of the longest and shortest group will be the length of the remaining group of liner elements. Thus, production of the liner elements is simplified, and where the modified liner elements are installed as a retrofit, most of the already existing bolt passages in the mill shell and liner elements can be used without change.

It is still further generally preferred that the bolt passages in a liner element have substantially equal distance from a hypothetical midline of the liner element. Where the distance of two bolt passages is relatively large, it is contemplated that support elements may be provided to the mill shell and/or the liner element to reduce excursion under load. With respect to the mill shell, it should be appreciated that especially preferred mill shells will have corresponding bolt passages and knock-out holes that are positioned outside a footprint of the peripheral device on the mill shell. Thus, such knock-out holes in combination with the liner elements presented herein will allow complete removal of the liner elements using the knock-out holes without the need to remove the external device.

Of course, it should be appreciated that the liner elements and methods contemplated herein are suitable for de-novo construction of grinding mills as well as for retrofitting already existing grinding mills. Consequently, where the liner elements are used for existing grinding mills, it is noted that most or all of the bolt passages in the liner elements will be determined by preexisting bolt passages in the mill shell and that the liner elements will therefore be substantially longer and corresponding connecting liner elements will be smaller. On the other hand, where the liner element is configured for a de-novo construction, the liner element may be similar or even identical in length as known liner elements, however, have the bolt passages located outside a footprint of the peripheral device. For example, suitable length of liner elements may be at least 2.5 m, and more typically at least 3.0 m. In still further contemplated aspects, the mill shell will also include knock-out holes for removal of the liner elements, and most preferably, the knock-out holes are positioned outside the footprint of the peripheral device and present in a number sufficient to allow for complete removal of the liner elements using the knock-out holes. Viewed from a different perspective, while it is preferred that the knock-out holes are proximal but not within the footprint of the peripheral device, knock-out holes may also be present within the footprint, but not essential for removal of the liner elements.

Moreover, it should be noted that while the configurations and methods contemplated herein are particularly suitable for ball grinding mills in mining operations, numerous other operations may also benefit from the inventive subject matter. For example, suitable mills may be operated in various chemical plants, power producing plants, and cement plants. Similarly, while ball grinding mills are especially contemplated, SAG (Semi-Autogenous Grinding) mills and other grinding mills are also deemed suitable for use herein. Therefore, it is contemplated that suitable peripheral devices also include various drive arrangements such as girth gears, etc.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A plurality of grinding mill liner elements for a mill shell having a peripheral device, comprising:

a first set of the plurality of liner elements having a first average length and a second set of the plurality of liner elements having a second average length, wherein the first and second average lengths are different;

wherein the plurality of liner elements comprises a plurality of bolt passages;

wherein the first set of the plurality of liner elements are sized and the bolt passages in the first set of the plurality of liner elements are placed to thereby position the bolt passages in the first set of the plurality of liner elements outside a footprint of the peripheral device on the mill shell when the plurality of liner elements are installed into the mill shell; and wherein the mill shell has a first end and a second end, and an outside surface between the first and second end, and wherein the peripheral device is a gearless motor drive having a stator coupled to the outside surface of the mill shell in a position between the first and second ends.

2. The liner elements of claim 1 wherein each of the plurality of liner elements has two bolt passages.

3. The liner elements of claim 1 wherein the bolt passages on each of the plurality of liner elements has substantially equal distance from a hypothetical midline of the liner element.

4. The liner elements of claim 1 further comprising a third set of the plurality of liner elements having a third average length, wherein the first, second, and third average lengths are different.

5. A grinding mill comprising a mill shell and at least one liner element according to claim 1.

6. The grinding mill of claim 5 wherein the liner element has a first length, and further comprising a second liner element having a second length, and wherein first and second lengths differ at least 20%.

7. The grinding mill of claim 5 wherein the liner element has a first length, and further comprising second and third liner elements having second and third lengths, respectively, and wherein the first, the second, and the third lengths are different.

8. The grinding mill of claim 5 wherein the mill shell comprises a plurality of knock-out holes that are positioned outside a footprint of a peripheral device on the mill shell, and wherein the plurality of knock-out holes are sufficient to allow for removal of the liner element using the knock-out holes.

9. The liner elements of claim 1, wherein the first and second average lengths are different by at least 10%.

* * * * *